United States Patent [19]

Mode

[11] Patent Number: 4,951,868

[45] Date of Patent: Aug. 28, 1990

[54] PRE-GLUED TAPERED TRAY WITH GUSSETS AND FLANGES

[75] Inventor: Duane R. Mode, Bloomington, Minn.

[73] Assignee: Waldorf Corporation, St. Paul, Minn.

[21] Appl. No.: 354,631

[22] Filed: May 19, 1989

[51] Int. Cl.[5] ..... B65D 5/24

[52] U.S. Cl. ..... 229/112; 229/125.35; 229/137; 229/170; 229/186; 229/905

[58] Field of Search ..... 229/3.1, 112, 125.35, 229/160, 170, 171, 182, 186, 905, 137, 138

[56] References Cited

U.S. PATENT DOCUMENTS

| | | | |
|---|---|---|---|
| 3,146,934 | 9/1964 | Steiger | 229/160 |
| 3,249,282 | 5/1966 | Kuehn, Jr. | 229/160 |
| 3,289,914 | 12/1966 | Lange-Wiehe | 229/160 |
| 3,399,820 | 9/1968 | Foster et al. | 229/37 |
| 3,550,835 | 12/1970 | Persson | 229/125.35 |
| 3,917,155 | 11/1975 | Bemiss | 229/160 |

FOREIGN PATENT DOCUMENTS

| | | | |
|---|---|---|---|
| 759819 | 5/1967 | Canada | 229/160 |
| 8301242 | 4/1983 | PCT Int'l Appl. | 229/170 |
| 303453 | 8/1968 | Sweden | 229/170 |

*Primary Examiner*—Gary Elkins
*Attorney, Agent, or Firm*—Dorsey & Whitney

[57] ABSTRACT

A container has a base panel of generally rectangular shape bounded by four edges. Two generally rectangular, opposed side panels are connected to the base. Each side panel is connected at one of its edges to one of two opposed edges of the base panel and projects upward therefrom. Two generally rectangular, opposed end panels are connected to the remaining opposed edges of the base panel and project upward therefrom. Four folded gussets are connected between the adjacent side panels and end panels, one at each of the corners of the base panel. A generally rectangular top panel lies substantially parallel to the base panel and has each of two of its opposed edges connected to one edge of each of the side panels. Each of the two remaining edges of the top panel forms one outer layer of a pair of substantially sealed, gathered end closures of the container. The other outer layer of each end closure is formed with a lip flap of one of the end panels, with at least one thickness of each gusset being sandwiched between the top panel and the end panel lip flap in each corner of each end closure.

10 Claims, 3 Drawing Sheets

PRE-GLUED TAPERED TRAY WITH GUSSETS AND FLANGES

TECHNICAL FIELD

The present invention relates to packaging. More particularly, the present invention relates to a package in which foods or other materials may be placed that has gussets and flanges to aid in leak-proof end sealing of the package.

BACKGROUND ART

In recent years, prepackaged, prepared foods have become increasingly popular. This has created an increasing demand for economical, simple, disposable containers, which, can provide sanitary, leak-proof containment of a variety of foods, including foods containing liquid. Paperboard cartons have been found to be an economical way to meet many packaging requirements. In particular, a number of cartons for frozen, refrigerated and shelf-stable foods have been successfully introduced that are made from paperboard coated with barriers to prevent absorption and wicking of liquids.

Although paperboard packages of many kinds are now widely sold, there are few packages that provide satisfactory performance where a tightly sealed, leak-proof carton is desired. One well-known example is the standard milk carton with a gusseted, gathered top that is sealed by joining multiple, overlapping edges in the center of one end and opened by separating a portion of the overlapping edges and unfolding one of the gussets.

SUMMARY OF THE INVENTION

In accordance with the present invention, a container for holding food or other items containing liquid has a base panel of generally rectangular shape bounded by four edges. Two generally rectangular, opposed side panels are connected to the base panel, such that each side panel is connected at one of its edges to one of two opposed edges of the base panel. Each side panel projects upward from the base panel. Two generally rectangular, opposed end panels are also connected to the base panel. Each such end panel is connected at one of its edges to one of the two remaining, opposed edges of the base panel and projects upward therefrom.

Four folded gussets are connected to the end panels and side panels. Each such gusset is connected between an adjacent side panel and end panel at each of the corners of the base panel. A generally rectangular top panel lies substantially parallel to the base panel and has each of two of its opposed edges connected to one edge of each of the side panels. The two remaining opposed edges of the top panel form one outer layer of a pair of substantially sealed, gathered end closures of said container, each said end closure being formed with an edge of one of said end panels forming the other outer layer of each end closure, with at least one thickness of each gusset being sandwiched between said top panel and said end panel in said end closure. The invention also encompasses a flat blank that can be folded and glued into a tubular blank with open ends and glued or sealed into the preceding package configuration. With proper selection of materials, the package is suitable for microwave or conventional ovens.

A primary objective of the present invention is to provide a package with compression-sealed ends that may be filled vertically.

Another objective of the invention is to provide a food package that is leak-proof throughout and can be used to contain food items with liquid content.

A further objective of the present invention is to provide a simple, paperboard blank from which a gusseted, tapered tray package can be easily formed.

These and other objectives of the present invention will become apparent with reference to the drawings, the description of the preferred embodiment and the appended claims.

DESCRIPTION OF THE PREFERRED EMBODIMENT

Figure 1:
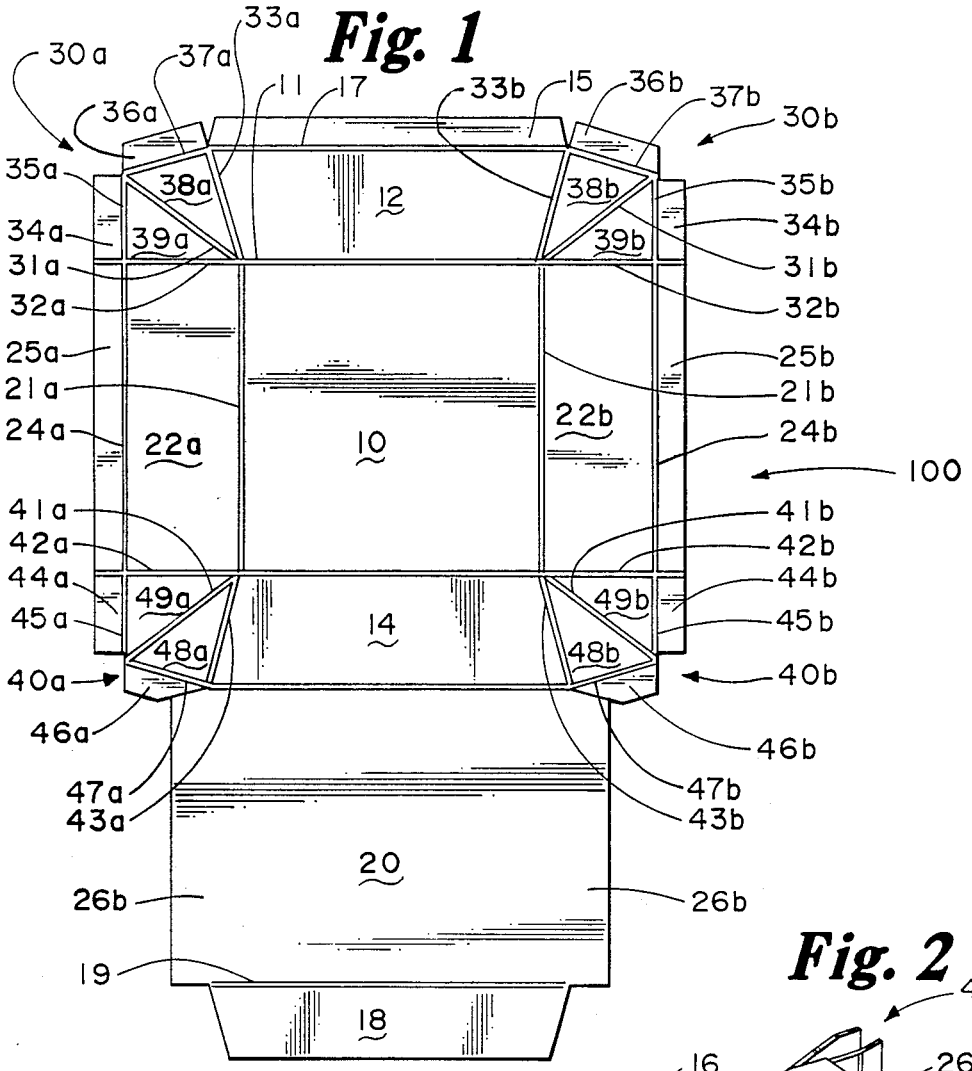
FIG. 1 is a top plan view of the paper blank of the subject of the invention, showing the die cut profile and bend scores.

As best seen in FIG. 1, a blank 100 in accordance with the present invention has a base panel 10 with four fold lines 11, 13, **21*a*, 21*b* defining its two opposed pairs of edges. (In the drawings, double lines indicate the scores used to form fold lines. Single solid lines indicate cuts or free edges.) Attached to the opposed, parallel edges 11, 13 are side panels 12, 14. The side panel 12 has along its outer edge a sift flap 15, connected to the side panel 12 at a fold line 17 parallel to the fold line 11. Attached to the side panel 14 at a fold line 16 lying parallel to the fold line 13 is a top panel 20. Each side panel 12, 14 is generally rectangular but preferably has a shorter edge along its fold line 11, 13, respectively, forming the connection to base panel 10, than along its opposed edge at fold line 17, 16, respectively. Lying parallel to the fold line 16 on the opposite side of the top panel 20 is a fold line 19, at which a seal flap 18 is joined to the top panel 20. Lying generally perpendicular to the fold lines 16, 19 are marginal seal strips or ledges 26*a*, 26*b*** that form part of the container sealing structure described later.

Because the structure of the blank 100 is symmetric about an axis oriented perpendicular to the fold lines 11, 13, 16, 17 and 19, the end wall structures of the right and left sides of the base panel 10 are mirror images of each other. Accordingly, only the structure on the left side (as seen in FIG. 1) will be described.

Joined to base panel 10 at fold line **21*a* is an end panel 22*a* of generally rectangular shape. Joined to this end panel 22*a* is an end lip flap 25*a* connected along a fold line 24*a*. Lying between the side panel 12 and the end panel 22*a* with end lip flap 25*a* is a gusset 30*a*. The gusset 30*a* is connected to end panel 22*a* and lip flap 25*a* at a fold line 32*a*. The gusset 30*a* is also connected to the side panel 12 at a fold line 33*a*. A further fold line 31*a*** extending outward from the corner of the base panel 10 separates the gusset 30a generally into two triangular panel halves 38a, 39a. Attached to the gusset panel 39a at a fold line 35a is a gusset lip flap 34a. Similarly, attached to the gusset flap 38a at a fold line 37a is a gusset sift flap 36a.

A gusset 40a is connected to the base panel 10 at the corner between end panel 22a with end lip flap 25a and side panel 14. The connection between gusset 40a and side panel 14 is along fold line 43a. The connection between gusset 40a and end panel 22a with end lip flap 25a is along fold line 42a. A further fold line 41a extends outwardly from the corner at which the side panel 14 and the end panel 22a meet. This fold line 41a separates the gusset 40a into two triangular panel halves, 48a, 49a. Attached to the outer edge of the gusset panel 48a at a fold line 47a is a gusset sift flap 46a. Attached to the gusset panel 49a at a fold line 45a is a gusset lip flap 44a.

As noted above, the structure of gusset 30a, end panel 22a, end lip flap 25a and gusset 40a is symmetrical to the corresponding structure on the right hand side of the blank as shown in FIG. 1. Accordingly, the above structural description for the left hand side of FIG. 1 applies, mutatis mutandis also to the right hand side of FIG. 1, with a suffix "b" being substituted for the suffix "a" for each applicable part number.

Figure 2:
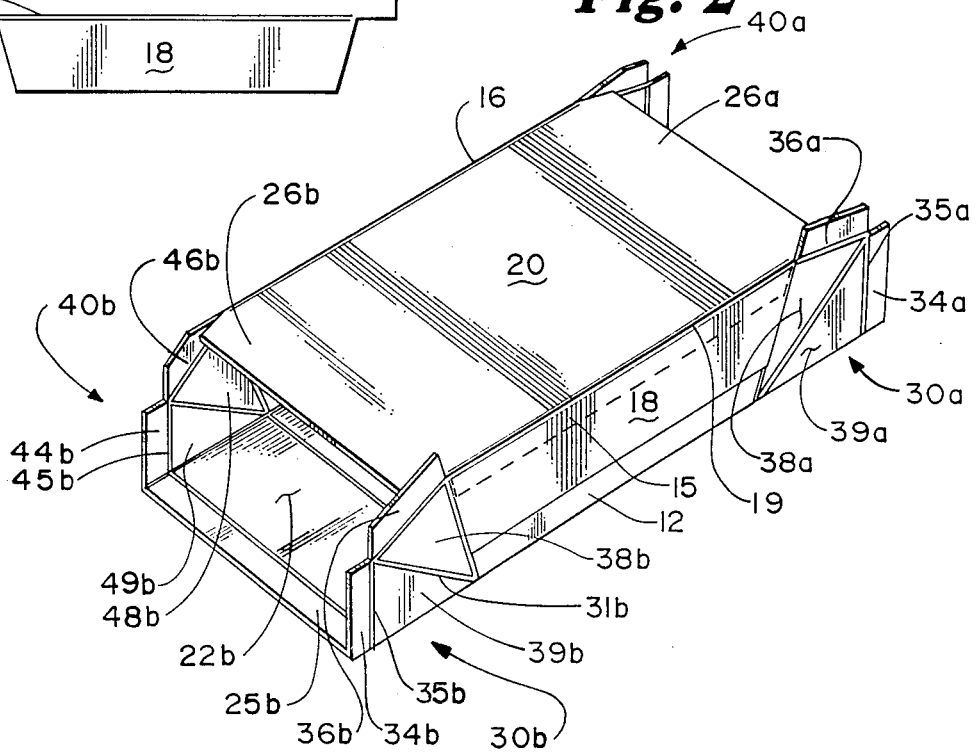
FIG. 2 is a perspective view of the first step in the assembly of the container of the present invention.

FIG. 2 shows the first step in the assembly of the container of the present invention, which would normally be done by the manufacturer of the carton blank. This first step consists of flame treating sift flap 15 and seal flap 18, then folding the carton together along fold line 13. Next, sift flap 15 and seal flap 18 are folded back onto side panel 12, affixing the seal flap 18 to the exterior of the side panel 12 so that sift flap 15 lies between seal flap 18 and side panel 12. The result is a tube, which, when erected as shown in FIG. 2, consists of the base panel 10 and top panel 20 lying parallel to each other and joined by the side panels 12, 14, with heat sealing of seal flap 18 onto side panel 12 and sift flap 15. Although not completely visible in FIG. 2, it should be noted that fold line 17 will lie inside fold line 19 and that sift flap 15 will be backfolded to lie adjacent side panel 12.

Figure 3:
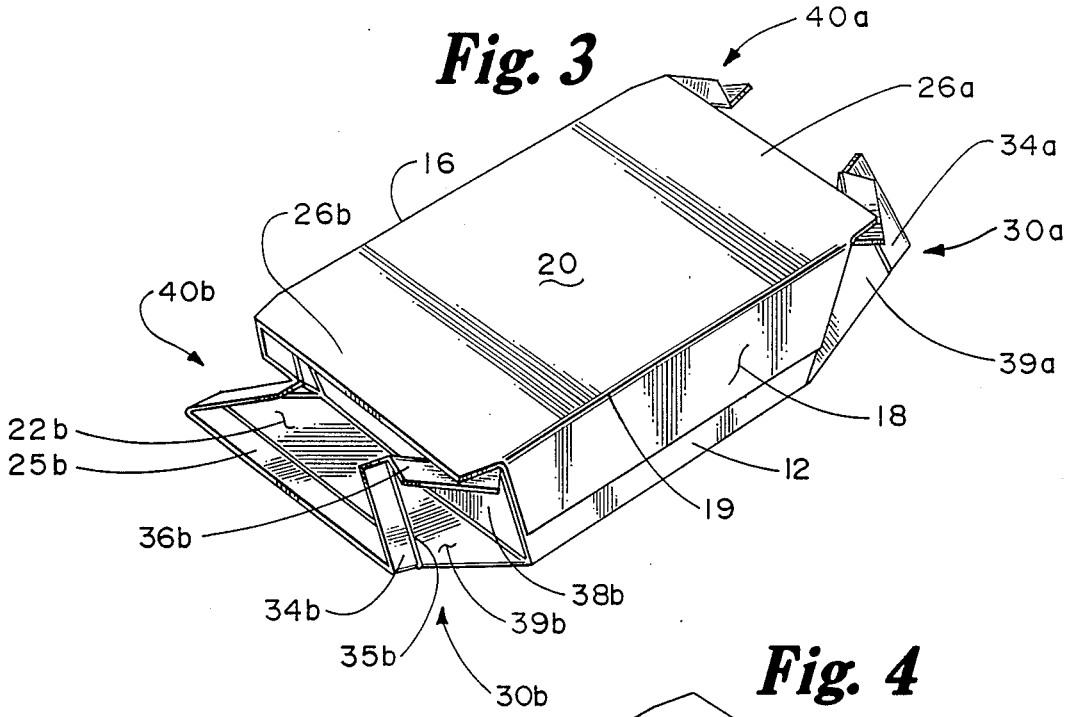
FIG. 3 is a perspective view of an intermediate step in the assembly of the container of the present invention.

FIG. 3 shows an intermediate step in the assembly of the container of the present invention. In this step, each of the gussets 30a, 30b, 40a, 40b is collapsed inwardly by folding along the fold lines 31a, 31b, 41a, 41b, as shown in FIG. 3. As the fold lines 31a, 31b, 41a, 41b are pushed inward, it will be seen that the end panels 22a, 22b are raised so that the end lip flaps 25a, 25b begin to approach the ledges 26a, 26b that extend from the opposed, free edges of the top panel 20. Also, as the gussets 30a, 30b, 40a, 40b collapse, the flaps and panels on opposite sides of the fold lines 31a, 31b, 41a, 41b begin to lie immediately adjacent each other, forming structures of double thickness.

Figure 4:
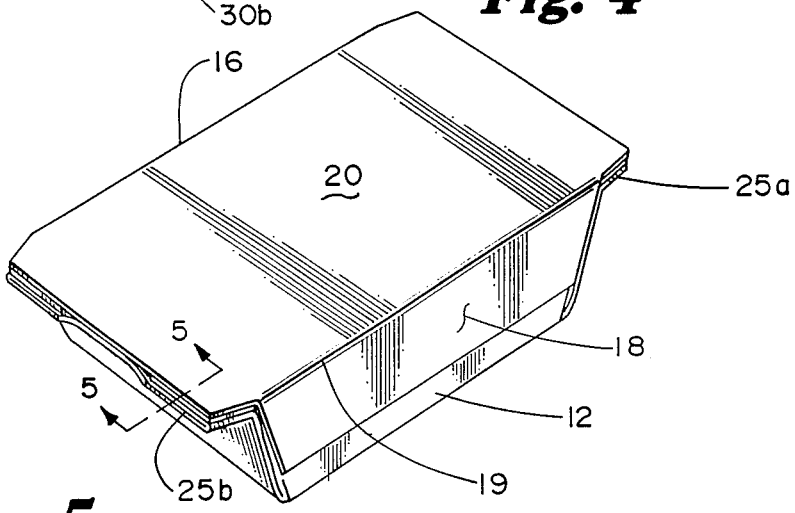
FIG. 4 is a perspective view of the final step in the assembly of the container of the present invention.
Figure 5:
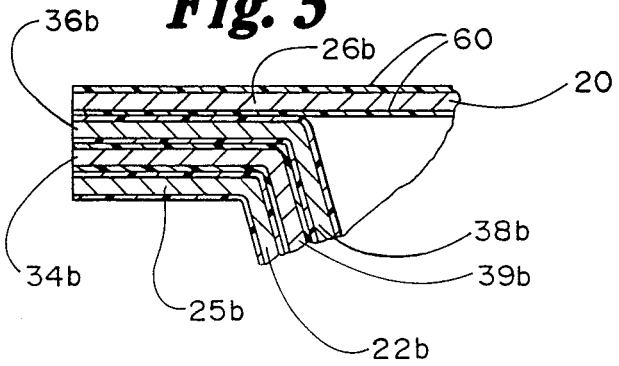
FIG. 5 is a sectional detail view taken along line 5—5 in FIG. 5.

In FIG. 4, the end seals are shown fully formed. The end lip flaps 25a, 25b together with the gusset lip flaps 34a, 34b, 44a, 44b are all mated against the gusset sift flaps 36a, 36b, 47a, 47b and the ledges 26a, 26b. Once all of these various flanges are gathered and aligned, sealing bars clamp down with heat and pressure to seal the end closures securely shut. Adhesion is preferably provided by the use of paperboard coated with polyester on both sides of the blank 100. The profile of each sealing bar should be such as to allow for holding and forming the various thicknesses together in an embossing manner to produce a sealed edge with the end profile shown in FIG. 4. FIG. 5 shows a sectional detail of the heat sealed, molded end closure that provides end sealing in the present invention. Ledge 26b of the top panel 20 provides one outer layer for the end seal. Lip flap 25b provides the other outer layer. Sandwiched between the two outer layers 26b, 25b are the gusset sift flap 36b and the gusset lip flap 34b. As can be seen, at each contact surface between adjacent flaps within the sealed edge, a layer of polyester coating 60 (only two of which are labeled with a number) faces another layer of polyester coating. This provides ample polyester material for the heat and pressure sealing contemplated for the invention, without the use of additional glues or adhesives.

As can be seen, the finished package, when sitting on its base panel 10 is in the form of a tray with end panels 22a, 22b that taper outward as they rise from the base to the end closures. Each end closure lies essentially in the plane of the top panel 20. When the package is to be filled, it would normally start out as the tube shown in FIG. 2. One end closure would be formed, then the package would be positioned with the remaining open end pointed upward. This would facilitate filling from above with liquid contents. After filling, the other end closure would be made to produce a fully-sealed package. While, as noted, the seal at each end closure is suitable for containing liquids, the package is also suitable for many dehydrated, shelf-stable foods, such as scalloped potatoes and pasta mixes. With proper selection of the polyester coating, the package could be used for "heat and eat" foods for either microwave or conventional ovens.

Figure 6:
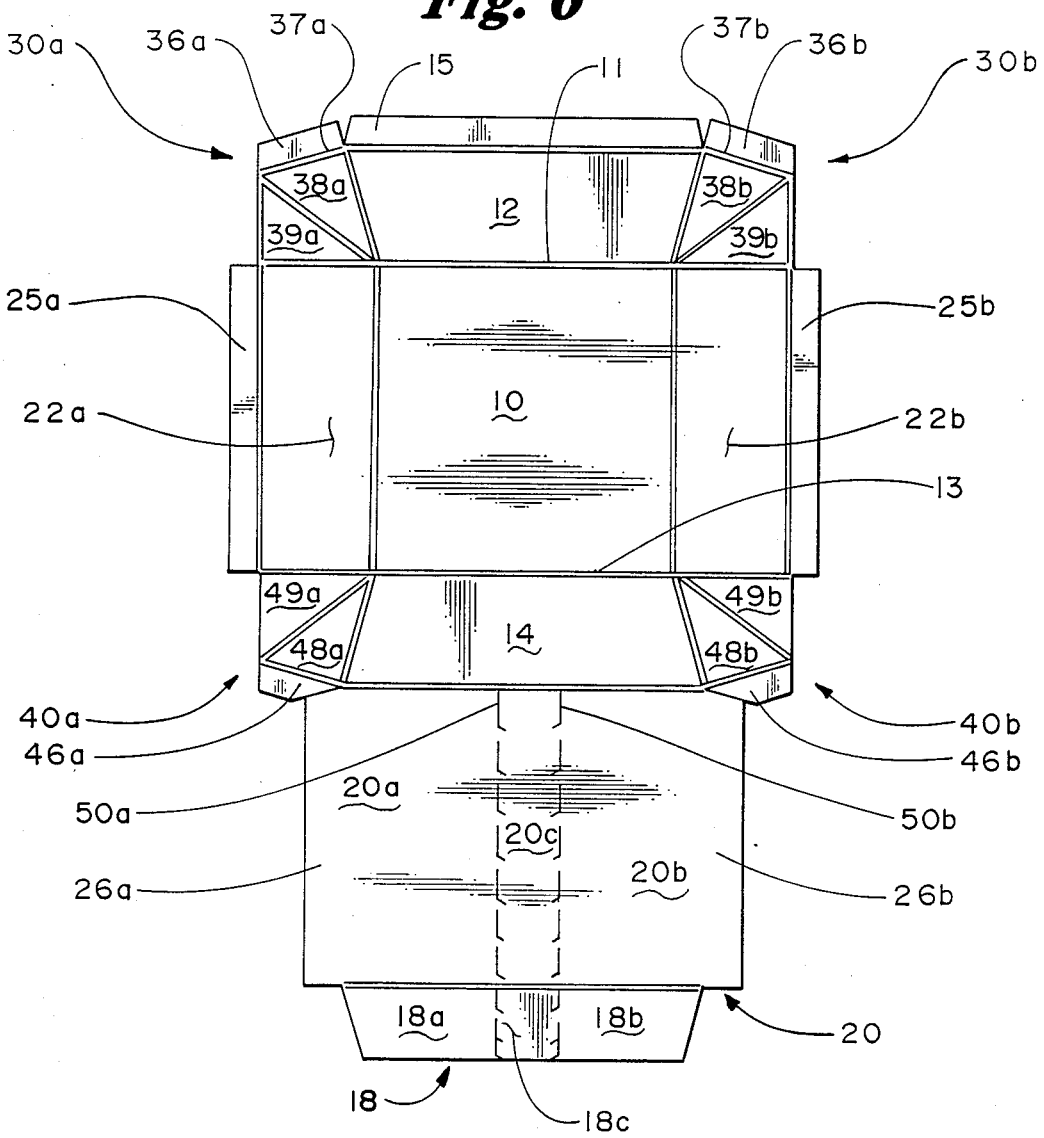
FIG. 6 is a top plan view of the paper blank of an alternate form of the subject of the invention.
Figure 7:
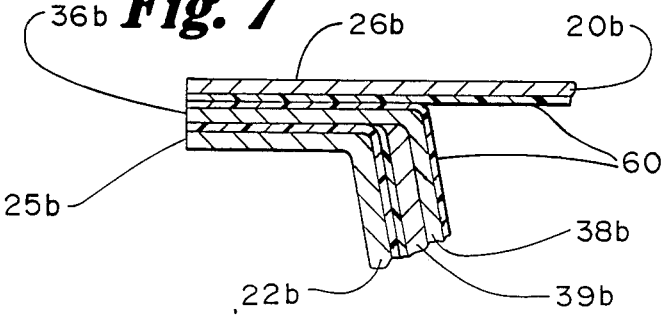
FIG. 7 is a sectional detail view as in FIG. 5, showing how the blank of FIG. 6 would be sealed.

FIG. 6 shows an alternative form of the present invention that very closely resembles the container shown in FIGS. 1–6. However, in this embodiment a lesser degree of sealing is acceptable, and it is possible to make the container with paperboard having polyester on only one surface. Also, in this embodiment an opener strip is present, formed by a pair of weaked 50% cut tear lines 50a, 50b that divide seal flap 18 into right, left and center components, 18a, 18b, 18c, respectively, and divide top panel 20 into similar right, left and center components 20a, 20b, 20c, respectively. The component 18c serves as a starter tab to initiate opening. In this form of the invention, the gusset lip flaps 34a, 34b, 44a, 44b are removed. When the blank of FIG. 6 is assembled in the same manner as shown in FIGS. 2–4, all the various end panels 22a, 22b and gussets 30a, 30b, 40a, 40b move in exactly the same fashion to form end closures with ledges 26a, 26b. The only difference in the end closures is that in this embodiment the paperboard is coated with polyester only on the inside. Accordingly, to provide heat sealing in a manner similar to that achieved with the embodiment of FIGS. 1–5, it is necessary that the paperboard surfaces joined at the end closures always include at least one surface area with polyester coating in contact with any opposing surface area that has no polyester coating. As can be seen in FIG. 7, showing a sectional detail of the end seal of the embodiment of FIG. 6 in a manner similar to FIG. 5, each of the contact interfaces between the three layers of paperboard involved in the end closure brings at least one polyester coated surface 60 (only two of which are labeled with a number) in contact with its adjacent surface. This provides a seal that is adequate for most dry products, although it may not be suitable for products with high liquid content or that require an extremely leakproof seal. In this embodiment's end closure, the ledge 26b and the lip flap 25a again form the outer layers of the end closure, but only one thickness of the gusset 30b, namely, gusset sift flap 36b, is present between these outer layers.

In summary, it can be seen that the present invention provides a carton that can be manufactured as a flat blank and sold either in that form or, preferably, as a sealed tube with special backfolding in the glue area to prevent wicking of contents. The ends of the cartons are designed so that a leak-proof, molded, end closure can be produced by heating and pressure sealing with clamping bars. When the container is made with paperboard coated with polyester on two sides, it is totally leak-proof; there are no raw edges of paperboard in contact with any package contents. When the paperboard is coated only on one side, a lesser seal is provided, but it would still be suitable for packaging dry materials whose nature is such that total resistance to wicking and sifting of contents is not necessary. The finished package (either embodiment) will stand on its edge on the shelf and will have a unique tapered look.

Although the description of the preferred embodiment and an alternative embodiment have been presented, it is contemplated that various changes could be made without deviating from the spirit of the present invention. Accordingly, it is intended that the scope of the present invention be dictated by the appended claims, rather than by the description of the preferred embodiment.

I claim:

1. A structure for forming a tray container comprising:

a base panel and a top panel, each being generally rectangular and having four corners, said base panel and top panel lying parallel and opposed to each other;

a pair of generally rectangular, opposed side panels connecting opposed edges of the base and top panels at fold lines to form a collapsible tube of generally rectangular cross-section with a pair of open ends when erected;

a pair of generally rectangular, opposed end panels, one such end panel being connected at a fold line to an edge of said base panel at each of the open ends of said tube;

a pair of gussets connected to each such end panel at fold lines, each of said pair of gussets also being connected at a fold line to the side panel adjacent said end panel to form a link between each said end panel and the adjacent side panel, each said gusset further having a fold line extending away from each corner of said base panel; and a lip flap connected to each said end panel at a fold line that is opposite the fold line connecting said end panel to said base panel, each said lip flap and at least one thickness of each gusset being gatherable upon folding of each end panel at its base panel fold line toward said top panel to form two end closures with outer and inner layers, each end closure extending between two corners of said top panel and having a top panel edge and the adjacent lip flap as its outer layers, with at least one thickness of each gusset being sandwiched between said top panel and said end panel lip flap as an inner layer at each corner of said top panel.

2. The structure of claim 1 wherein the side panels and end panels are integrally formed with said base panel.

3. The structure of claim 2 wherein the four gussets are integrally formed with said side panels, end panels and base panel.

4. The structure of claim 3 wherein the top panel is integrally formed with said gussets, side panels, end panels and base panel.

5. The structure of claim 4 wherein the two opposed end walls project upward with an included angle between said base panel and each of said two opposed end walls that is greater than ninety degrees.

6. The structure of claim 1 wherein the structure is made from paperboard that has polyester coating on at least one side.

7. The structure of claim 1 wherein said top panel is generally planar and each end closure is substantially in the plane of the top panel.

8. The structure of claim 1 wherein two thicknesses of each gusset are sandwiched between said top panel and said end panel lip flap in each end closure.

9. The structure of claim 1 wherein the structure is made from paperboard covered with a polyester coating on at least one side and each end closure is formed by heat and pressure applied to the end closure.

10. The structure of claim 9 wherein the structure is made from paperboard covered with a polyester coating on both sides.

* * * * *